175-50 SR
1/29/85 XR 4,495,804

United States Patent [19]

Le Blanc Smith et al.

[11] Patent Number: 4,495,804

[45] Date of Patent: Jan. 29, 1985

[54] METHOD OF AND APPARATUS FOR MINING ANALYSIS

[75] Inventors: Guy Le Blanc Smith, Randburg; Derik Howard, Johannesburg, both of South Africa

[73] Assignee: Grathnail Development Company Limited, St. Peter, Channel Islands

[21] Appl. No.: 348,954

[22] Filed: Feb. 16, 1982

[30] Foreign Application Priority Data

Feb. 17, 1981 [ZA] South Africa ..... 81/1035

[51] Int. Cl.[3] ..... E21B 49/00

[52] U.S. Cl. ..... 73/152; 73/432 R; 299/1; 175/50

[58] Field of Search ..... 299/1; 175/50; 73/432 B, 432 R, 152

[56] References Cited

U.S. PATENT DOCUMENTS

| | | | |
|---|---|---|---|
| 2,018,080 | 10/1935 | Martinssen | 73/152 X |
| 2,207,281 | 7/1940 | Athy et al. | 73/152 X |
| 3,234,788 | 2/1966 | Talobre | 73/152 |
| 3,646,997 | 3/1972 | Chenevert | 175/50 X |
| 3,690,164 | 9/1972 | Gabillard et al. | 73/152 X |
| 3,786,684 | 1/1974 | Wiess et al. | 73/432 B |
| 3,922,015 | 11/1975 | Pounstone | 175/50 X |
| 3,993,127 | 11/1976 | Chepeleu et al. | 73/151 X |
| 4,003,260 | 11/1977 | Catoul | 73/864.31 X |
| 4,009,609 | 3/1977 | Sayer et al. | 73/152 X |
| 4,131,018 | 12/1978 | Müller et al. | 73/432 B |

FOREIGN PATENT DOCUMENTS

| | | | |
|---|---|---|---|
| 2908351 | 9/1980 | Fed. Rep. of Germany | 73/432 B |
| 2039093 | 7/1980 | United Kingdom | 73/152 |

*Primary Examiner*—S. Clement Swisher
*Assistant Examiner*—Tom Noland
*Attorney, Agent, or Firm*—Schwartz, Jeffery, Schwaab, Mack, Blumenthal & Koch

[57] ABSTRACT

In the analysis of rock ahead of a working face a probe is pushed along a borehole formed in any desired direction in the rock and data produced by the probe is logged for later analysis, or for in-situ analysis. The probe may produce multiple logs. The data logged includes lithological information on the rock and the angular direction of the borehole. The presence of fluids, such as noxious gases, in the borehole can simultaneously be detected.

7 Claims, 3 Drawing Figures

METHOD OF AND APPARATUS FOR MINING ANALYSIS

BACKGROUND OF THE INVENTION

This invention relates broadly to the mining of minerals, and particularly to the mining of strata bound deposits such as gold, uranium and coal, and non-stratiform deposits. The scope of the invention is however not limited to these named applications.

In all mining situations the ore-bearing zones vary both quantitatively and qualitatively. The ability to mine a particular ore therefore depends on precise knowledge of the characteristics of the rock at a given working face. This information permits the selection of economic mining horizons and enables the grade of ore mined and the production rate to be controlled. Intimately associated with these objectives are the monitoring of foot wall and hanging wall conditions and the negotiation of structural discontinuities.

At present a mine is planned on data collected from exploration drill holes. As surface drilling is expensive the drill holes are widely spaced and can therefore only indicate the general nature of the ore body. More pertinent data is therefore collected during mining operations at the face. The present precedure for quality control involves the manual collection of samples at the working face at regular intervals. The samples are analysed and the mining thereafter proceeds on the analyses and predictions arising therefrom and on the other data which is normally employed. The problem with this technique however is that the analysis is dependent on the properties of the mining face itself, where mining is actually taking place, and that account is not taken of the properties of the rock remote from the face; thus the mining proceeds and is corrected when the interpreted results are available.

Each mine has its own particular problems. For example in tin mining the pay zones are frequently irregularly distributed. In many sulphide deposits the economic limit may be expressed as a function of various contributing metals. In multi-seam and multi-product coal mines the positions, grades and dimensions of the various seams must frequently be monitored.

When test boreholes are drilled from surface it is commonplace to make use of wire line logs for continuously sampling the boreholes. Such devices are however not suitable for underground use where the test drilling may take place in all directions including the vertical upward direction.

U.S. Pat. No. 3,015,477 proposes a coal-rock sensing device which employs test probes adjacent the cutting bits of a coal mining machine. The technique enables the machine to be kept "on course" but in other respects it is only of limited value.

SUMMARY OF THE INVENTION

It is an object of the present invention to provide an improved method of mining analysis.

The method of the invention includes the steps of locating a probe in a borehole formed in rock ahead of a rock face, causing the probe to move along the borehole, and logging data obtained from the probe relating to the rock.

The probe employed may provide information on a single characteristic or alternatively on multiple characteristics. Primarily the logged data pertains to physcial characteristics of the rock itself and more particularly to the position and grade of a desired ore in the rock. Related information essential for the effective and safe mining of the ore and which may be provided by the probe pertains to fractures, cavities, discontinuities and the like in the rock.

Further, in accordance with the invention, the method includes the step of logging the deviation of the borehole. This data relates to the angular direction of the borehole and to the deviation of the angular direction from a reference line.

Also in accordance with the invention the presence of a predetermined fluid in the borehole may be detected. Such fluids may be gaseous e.g. a noxious or combustible gas, or liquid such as water. In the latter case it may be desired to detect water at high pressure ahead of the working face or water containing trace elements. The early detection of pressure and noxious gas deposits enables degassification to take place in a controlled and safe manner.

In a preferred form of the invention the probe is forced to move at least in one direction along the borehole by means of substantially rigid pushrod means. The use of pushrods enables the probe to be used in all boreholes regardless of their inclinations. Alternatively the probe may be caused to move at least in one direction along the borehole by the application of a pressurised fluid to the probe.

For example compressed air or pressurized water may be introduced into the borehole at its mouth, which is otherwise sealed off, so as to drive the probe along the borehole.

The invention also provides apparatus for mining anaylsis which comprises a probe, means for causing the probe to move along a borehole formed in rock ahead of a working face, and means for recording data produced by the probe relatively to the position of the probe in the borehole.

The probe employed may provide data on a single characteristic or alternatively on multiple characteristics. Thus the probe may be a compound probe and include a plurality of sensing or detection devices. Depending on the application the data recorded can be based at least on radiometric measurements e.g. gamma ray or neutron logs, electrical measurements such as self-potential, resistance or resistivity, or induced polarisation logs, or on induction, sonic or x-ray fluorescence logs, or on any other characteristic or property.

Primarily data on the physical characteristics of the rock will be logged and more particularly data relating to the position, dimensions and grade of ore bodies as well as data relating to discontinuities, fractures and the like in the rock.

The probe may also include a deviometer for providing data on the direction of the borehole. The deviometer may be of any suitable type e.g. magnetic, gravitational or gyro-based, but preferably is of the inertia type so that it is independent of the type of borehole casing, if any.

The apparatus may further include means for detecting the presence of a predetermined fluid such as water or a noxious or combustible gas in the borehole.

In accordance with the invention the means for causing probe movement comprises a plurality of interconnectable substantially rigid pushrods, which may be articulated.

The pushrods may be employed to move the probe in either direction along the borehole. In an alternative form of the invention the pushrods are used to move the probe in one direction along the borehole i.e. away from the mouth of the borehole and the probe is withdrawn from the borehole by means of a cable which is attached to the probe and which is otherwise moved together with the probe.

The correlation of the probe's signals to its position may be achieved in a number of ways. For example movement of the probe by means of the pushrods may cause dependent movement, directly or indirectly, of a medium employed for actually recording the probe signals. Alternatively the parameters of probe signals and probe position may be correlated on a time basis by recording the position of the probe against time, and simultaneously recording the signals on the same time scale. The two separate records may then be combined to obtain a time independent record of probe signal versus position.

In accordance with the invention the recorded information is analysed by known techniques, preferably with the aid of a computer, and information is derived relating to the optimum manner of mining. The analysis may take place on site or the recorded data may be conveyed to surface for processing there.

BRIEF DESCRIPTION OF THE DRAWINGS

The invention is further described by way of example with reference to the accompanying drawings in which.

DESCRIPTION OF PREFERRED EMBODIMENTS

Figure 1:
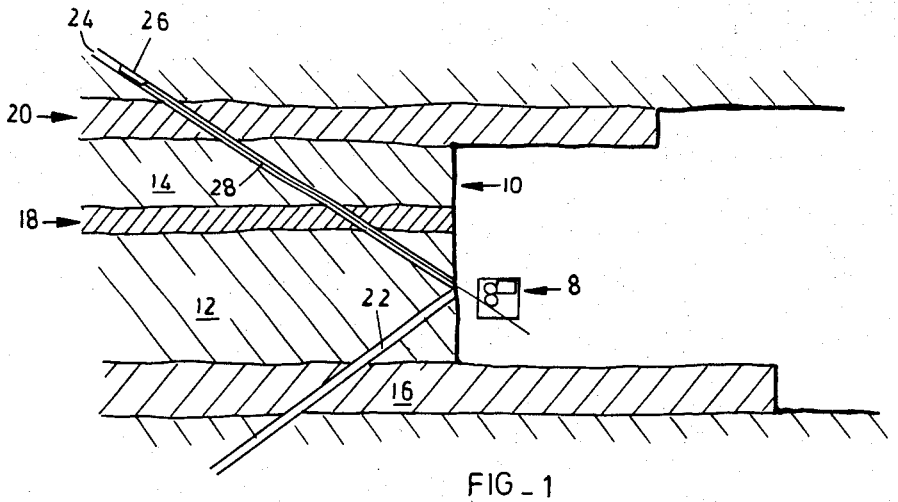
FIG. 1 is a view in elevation schematically depicting the underground use of mining analysis apparatus according to the invention.

FIG. 1 illustrates equipment 8 according to the invention in underground use. The equipment is located adjacent a coal seam at a working face 10. The seam is shown with layers 12 and 14 of good quality coal, and layers 16, 18 and 20 for poor quality coal.

In this situation and for illustrative purposes it has been assumed that, because of economic considerations, it has been calculated that the seam may optimally be mined by extracting the layers 12 and 14 of good quality coal, together with the rather narrow layer 18 of poor quality coal, and subsequently mining the layers 16 and 20. In order to do this efficiently it is necessary to determine all the relevant parameters of each layer, e.g. its grade, depth, width, inclination, etc.

This is achieved in accordance with the invention in the following way. A number of boreholes 22, 24 are bored into the face so that the coal seam is intersected in predetermined directions. A geophysical sonde 26 is then used, in each borehole in turn, to log the ore characteristics as a function of the length of the borehole measured from the face. The sonde 26 is caused to move along the borehole by means of the equipment 8 which also logs the data.

Clearly the information must be related to the direction and position of the borehole. The angular direction of the borehole in the vertical plane is easily measured while the angular direction in the horizontal plane is readily measured from a given reference vertical plane. The height of the mouth of the borehole may be measured from the footwall, or its distance from the hanging may be measured, or some other suitable reference may be used.

Figure 2:
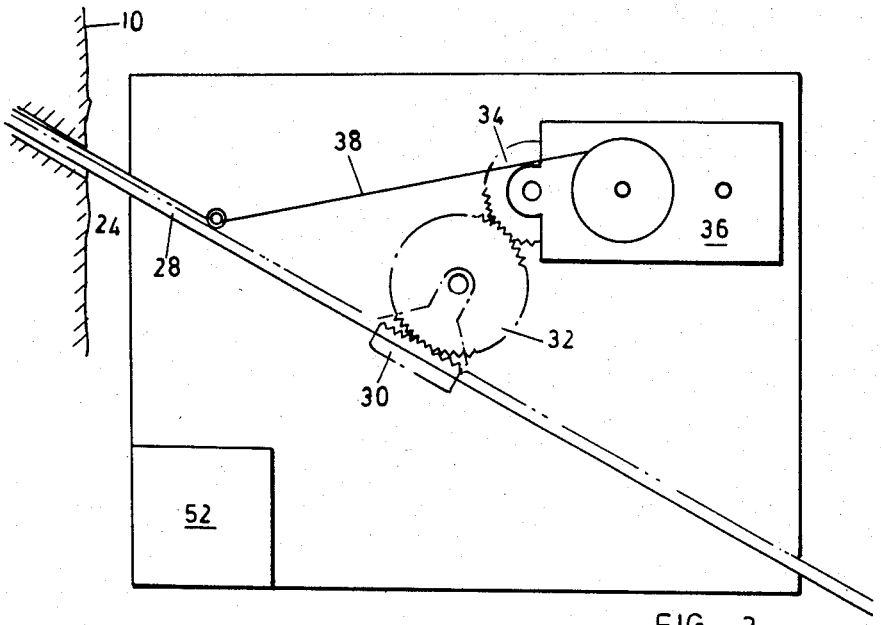
FIG. 2 is a more detailed illustration of the apparatus of FIG. 1.

FIG. 2 illustrates the principle employed in the equipment 8. A plurality of interconnected pushrods 28 are fixed to the sonde 26 and in this way the sonde can be caused to move along a borehole, whatever its orientation i.e. upwardly, downwardly, horizontally, etc. The number of pushrods used is determined only by the length of the borehole and, as the sonde is withdrawn, the pushrods may be uncoupled to facilitate their handling.

Each of the pushrods is formed with teeth along its length and, in effect, forms a rack. The design is such that the teeth at the ends of adacent rods are regular and, for practical purposes, the assembly of pushrods forms an elongate rack.

The pushrods pass through a guide 30 which is pivotally fixed to the axis of rotation of a pinion 32 which meshes with the rack. The guide 30 allows the rods to be at any angle in the vertical plane and at the same time keeps the pinion and the rack securely engaged with each other.

The pinion 32 meshes with a cog 34 and thereby drives a tape advance mechanism of a cassette recorder 36.

The sonde 26 in its travel along the borehole generates electrical signals, in a known way, which are dependent on the characteristics of the ore body or rock or cavities therein. These signals are transmitted via cable 38 to the recorder.

Since the recorder is advanced in a manner which is determined precisely by the rack and pinion arrangement the recorded electrical signals are easily correlated to distance along the borehole under measurement i.e. the sonde's position inside the borehole.

The equipment is used in this way, for each borehole, to log accurately the ore and rock characteristics as a function of distance from the face 10. Since the direction and position of each borehole are known the data may be analysed, in a known way, to build up with considerable accuracy a complete picture of the ore body to be mined. Armed with this information a precise determination can be made of the manner in which mining of the face is to be carried out.

The rods 28 may have a cross sectional shape with approximates a "D" with the teeth being formed on the flat vertical side of the D. The cable 38 may then conveniently by located adjacent this side. Alternatively each of the rods can be formed with a longitudinal channel which receives the cable, or can have cable gripping catches, which prevent the cable from inadvertently becoming wedged in the borehole. The rack and pinion arrangement is by no means the only way in which the data can be recorded as a function of distance. The pushrods, for example, could be formed more simply, without teeth, and carry a cord, cable or the like flexible member which is graduated to measure distance and coiled with the recorder or used to drive the recorder. The cable can be secured to the sonde, or to the leading end of the assembly of pushrods, so that the cable can be reeled in to withdraw the sonde and rods from the borehole. In the illustrated example the cable 38 could simultaneously serve for the transmission of the sonde signals and for the measurement of the sonde position.

Alternatively use could be made of a second recorder which runs at the same speed as the first recorder, or is otherwise synchronized with it, to record the movement of the rods. For example the rods could be fitted with magnets at regular intervals and the passage of the magnets is sensed by a suitable detector and recorded.

The recording of the sonde signals is then carried out as before, on the first recorder, and at a later stage the two sets of signals are correlated.

The rack and pinion arrangement could also be replaced by a simple roller which is frictionally engaged with the rods, and which is rotated by their movement, thereby to drive the recorder.

The rods 28 can be articulated and interconnected for example by means of swivel joints, such as ball and socket couplings. This permits the rods to follow changes of direction of the borehole. More simply though the rods may be flexible, for example of aluminium or glass or carbon fibre, so that they can transmit the pushing force whilst retaining torsional stability particularly in the case where the rack and pinion arrangement is employed to measure the position of the sonde. The rods may be hollow or solid, with any suitable profile and may be screw coupled together, or have interlocking bayonet-type catches, or any other quick coupling means.

The invention has been described in connection with coal mining, and where appropriate, the apparatus will be flame-proofed for use in fiery mines. The principles and use of the invention are of course not limited to coal mining and the invention may be employed in any other type of exploratory and analytical role. The type of use envisaged naturally determines the type of probe or sonde employed and again, the invention is not restricted to a particular probe type. Suitable probe types are however described in CIM Bulletin, April 1981, Volume 74, No. 828 at page 84 et seq. Alternatively or additionally the probe employed may include an optical viewer with the optical image being conveyed to the rockface via a fibre optic cable. This technique permits direct visual examination of the ore and rocks, and structural features, etc in the rock.

If a long borehole is drilled ahead of the working face then deviation or deflection of the borehole can be expected. The deviation must be determined so that the true position of the characteristics detected by the probe can be fixed. In accordance with the invention the probe carried by the assembly of pushrods may also include a deviometer for this purpose. The data provided by the deviometer permits the data from the sonde to be placed in true spatial and dimensional relationship.

In a similar manner use may be made of a detector for sensing the presence of noxious gases or pressure water or any other fluid in the borehole. The invention permits the position of the sensed liquids to be determined in the borehole, relatively to the ore body.

It is not essential to employ the pushrods to advance the probe along a borehole, particularly where the borehole includes a casing.

Figure 3:
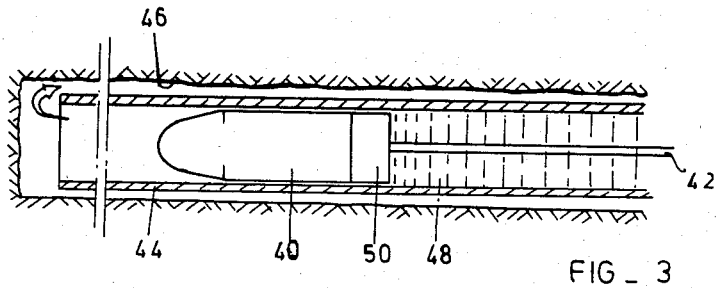
FIG. 3 illustrates an alternative arrangement of the invention.

FIG. 3 illustrates a probe 40 with a trailing cable 42 located inside a rigid casing 44 of a borehole 46. The probe 40 is caused to advance along the borehole, deeper into the borehole, by introducing a pressurized fluid 48 into the borehole so that a net force is exerted on the probe by virtue of the differential pressure prevailing between the opposing ends of the probe. Fluid in the casing displaced by the advancing probe is expelled through the annular gap between the casing and the wall of the borehole. Once the probe has reached the desired position in the borehole it is retracted in a controlled manner by tension on the cable 42. Data from the probe is transmitted by the cable 42 and the cable 42 is simultaneously employed to prove a measure of the position of the probe in the borehole. Where the probe is employed in overhead boreholes it can be prevented from running down the borehole under the action of gravity simply by having it frictionally engage the inner wall of the casing 44. Such a tight engagement also acts as a seal to prevent the pressurized liquid bypassing the probe. As an alternative arrangement the probe can be wedged in a suitable formation at the end of the casing. The casing may then include a window which is transparent to the signals detected or employed by the probe, or an aperture adjacent the probe. Data from the probe is then recorded as the casing is withdrawn, and the casing itself is used to provide a measure of the position of the probe. The casing thereby essentially takes the place of the pushrods 28.

In all cases thus far the data from the probe has been described as being transmitted to the recorder via hardwire techniques. Clearly this is not essential and if the cable proves cumbersome, it can be dispensed with and replaced by a radio transmitter or transponder 50 carried in the probe. The transmitted signal is then received at the recorder by means of a suitable radio receiver 52. If pushrods are employed they could be metallic, or have metallic elements embedded in them, to act as a conductive guide for the propagation of the radio waves. Similarly, if the probe is in a metallic casing, the casing will function as a waveguide type structure, and assist the propagation of the radio waves, at least over reasonable distances.

The data produced with the apparatus of the invention may be processed rapidly by means of a computer on site or on surface and, once processed, the data is utilized at the face for optimum mining of the ore body. The data is also available for other purposes e.g. financial and mine production planning, marketing and exploration. The advantage of the invention lies in the fact the ore body or bodies are sampled, in all directions from the mining face, in a rapid, accurate and simple manner.

In this specification the expression "rock face" or "mining face" includes the actual working face where mining operations are in progress and it also includes underground surfaces where general exploration and sampling takes place, for example in situations where old workings are reassessed, possibly because of mining technology or market value changes.

I claim:

1. A method of mining analysis in an underground mine comprising the steps of:

forming a plurality of boreholes in predetermined directions in rock ahead of a rock face in said underground mine, at least one of said bore holes being at an angle to the others;

for each borehole, locating a probe in the borehole;

causing the probe to move along the borehole; and logging data which is obtained from the probe and which relates to the rock, in a recorder.

2. A method according to claim 1 which includes the step of processing and utilizing the data for optimum mining of ore in the rock.

3. A method according to claim 1 in which the data obtained from the probe is transmitted by means of a radio signal to the recorder.

4. A method according to claim 1 in which the logged data relates to the rock in which each borehole is formed.

5. A method according to claim 4 in which the logged data relates to the position, dimensions and grade of ore bodies in the rock.

6. A method according to claim 4 in which the logged data relates to discontinuities in the rock.

7. A method according to claim 1 wherein the probe provides data on a plurality of characteristics of the rock.

* * * * *